US005613927A

United States Patent [19]

Rothacker

[11] Patent Number: 5,613,927

[45] Date of Patent: Mar. 25, 1997

[54] WRIST WRESTLING AND EXERCISE APPARATUS

[76] Inventor: Alex M. Rothacker, 1460 E. Belvidere Rd., Grayslake, Ill. 60030

[21] Appl. No.: 594,687

[22] Filed: Jan. 31, 1996

[51] Int. Cl.[6] ..... A63B 21/02

[52] U.S. Cl. ..... 482/123; 482/905; 482/44; 482/129

[58] Field of Search ..... 482/8, 44, 45, 482/46, 93, 94, 97, 123, 129, 905, 126

[56] References Cited

U.S. PATENT DOCUMENTS

| | | | |
|---|---|---|---|
| D. 261,294 | 10/1981 | Clink et al. . | |
| 2,542,074 | 2/1951 | Bierman | 482/46 |
| 3,735,983 | 5/1973 | Ortiz . | |
| 4,131,275 | 12/1978 | Gandy et al. . | |
| 4,184,675 | 1/1980 | Rogerson . | |
| 4,258,913 | 3/1981 | Brentham | 482/45 |
| 4,427,194 | 1/1984 | Dion . | |
| 4,463,949 | 8/1984 | McCoy, Sr. et al. . | |
| 4,509,747 | 4/1985 | Martin . | |
| 4,557,481 | 12/1985 | McClure . | |
| 4,575,076 | 3/1986 | Reichert et al. . | |
| 4,603,857 | 8/1986 | Chipman et al. . | |
| 4,805,900 | 2/1989 | Sapp . | |
| 4,822,027 | 4/1989 | Kascak | 482/46 |
| 4,846,468 | 7/1989 | McCoy, Sr. et al. . | |
| 5,087,031 | 2/1992 | Hoff | 482/46 |
| 5,380,259 | 1/1995 | Robertson et al. | 482/45 |
| 5,431,616 | 7/1995 | Centofante . | |

FOREIGN PATENT DOCUMENTS

| | | | |
|---|---|---|---|
| 1729534 | 4/1992 | U.S.S.R. | 482/46 |

*Primary Examiner*—Lynne A. Reichard
*Attorney, Agent, or Firm*—Marshall, O'Toole, Gerstein, Murray & Borun

[57] ABSTRACT

A wrist wrestling and exercise apparatus having a first configuration adapted to facilitate wrist wrestling contests and a second configuration adapted to allow exercise of the forearm. When configured for wrist wrestling, the apparatus has a base, a first forearm support disposed on the base, and a second forearm support disposed on the base. A first handle is associated with the first forearm support, and a second handle is associated with the second forearm support. Each of the handles is adapted to be gripped by a hand of a person and is movable relative to one of the forearm supports. The apparatus includes means for operatively interconnecting the first and second handles so that displacement of one handle relative to the one of the forearm supports causes displacement of the other handle relative to the other forearm support. When configured for exercising, the apparatus comprises a base, a forearm support disposed on the base, and a handle associated with the forearm support, the handle being adapted to be gripped by a hand of a person and being movable relative to the forearm support. In this configuration, the apparatus also includes a resistance member, such as a set of springs or weights.

14 Claims, 2 Drawing Sheets

WRIST WRESTLING AND EXERCISE APPARATUS

BACKGROUND OF THE INVENTION

The present invention relates to a wrist wrestling and exercise apparatus adapted to facilitate wrist wrestling contests and exercise of the forearm.

There are a number of devices that have been designed to facilitate arm wrestling contests and corresponding exercise of a person's arms, such as the arm wrestling device disclosed in U.S. Pat. No. 4,131,275 to Gandy, et al., for example. However, devices which facilitate arm wrestling are not suitable for use in wrist wrestling, which by nature is substantially different than arm wrestling. In arm wrestling, the strength of the entire arm, including the forearm and the upper arm including the biceps, is important. However, in wrist wrestling, which tests the ability of a person to bend the wrist against a resistance, the strength of the forearm is of primary importance, while the strength of the upper arm is not important.

Various exercises, such as wrist curls, may be performed to strengthen the forearm. Wrist curls are performed by resting one's forearm directly over one's thigh, with the palm of the hand facing upwards, and with a dumbbell in the palm of the hand, bending the wrist so that the hand holding the dumbbell moves from a relatively low position to a relatively high position. Reverse wrist curls may be performed in a similar manner, except that the palm of the hand faces downwards. Although they are generally targeted to exercise the forearm, those forms of exercise are not considered optimal since they do not completely isolate the forearm due to the person having to exert strength to maintain the forearm in position while doing the wrist curls.

SUMMARY OF THE INVENTION

The invention relates to a wrist wrestling and exercise apparatus which has a first configuration adapted to facilitate wrist wrestling contests and a second configuration adapted to allow exercise of the forearm.

When configured for wrist wrestling, the apparatus has a base, a first forearm support disposed on the base, and a second forearm support disposed on the base. A first handle is associated with the first forearm support, and a second handle is associated with the second forearm support. Each of the handles is adapted to be gripped by a hand of a person and is movable relative to one of the forearm supports. The apparatus includes means for operatively interconnecting the first and second handles so that displacement of one handle relative to the one of the forearm supports causes displacement of the other handle relative to the other forearm support.

Each of the forearm supports may be inclined at an angle of between about 10° and about 70° with respect to a horizontal plane, and each forearm support may include a support member adapted to support a forearm, an elbow support coupled to the support member, and means for adjusting the position of the elbow support along the support member. The means for interconnecting the two handles may be a cable connected to the handles and a plurality of pulleys for supporting the cable.

The apparatus may include a first detector associated with the first forearm support for detecting the position of the hand of a first person and a second detector associated with the second forearm support for detecting the position of the hand of a second person. Each detector may be composed of means for generating a horizontally disposed beam at a location below an upper edge of one of the forearm supports.

A first visual indicator, such as a light bulb, may be operatively coupled to the first detector to generate a visual signal indicating that the hand of the first person has reached a predetermined position, and a second visual indicator may be operatively coupled to the second detector to generate a visual signal indicating that the hand of the second person has reached a predetermined position.

When configured for exercising, the apparatus comprises a base, a forearm support disposed on the base, and a handle associated with the forearm support, the handle being adapted to be gripped by a hand of a person and being movable relative to the forearm support. In this configuration, the apparatus also includes means operatively coupled to the handle for providing resistance against movement of the handle relative to the forearm support, such as a set of springs or weights.

These and other features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
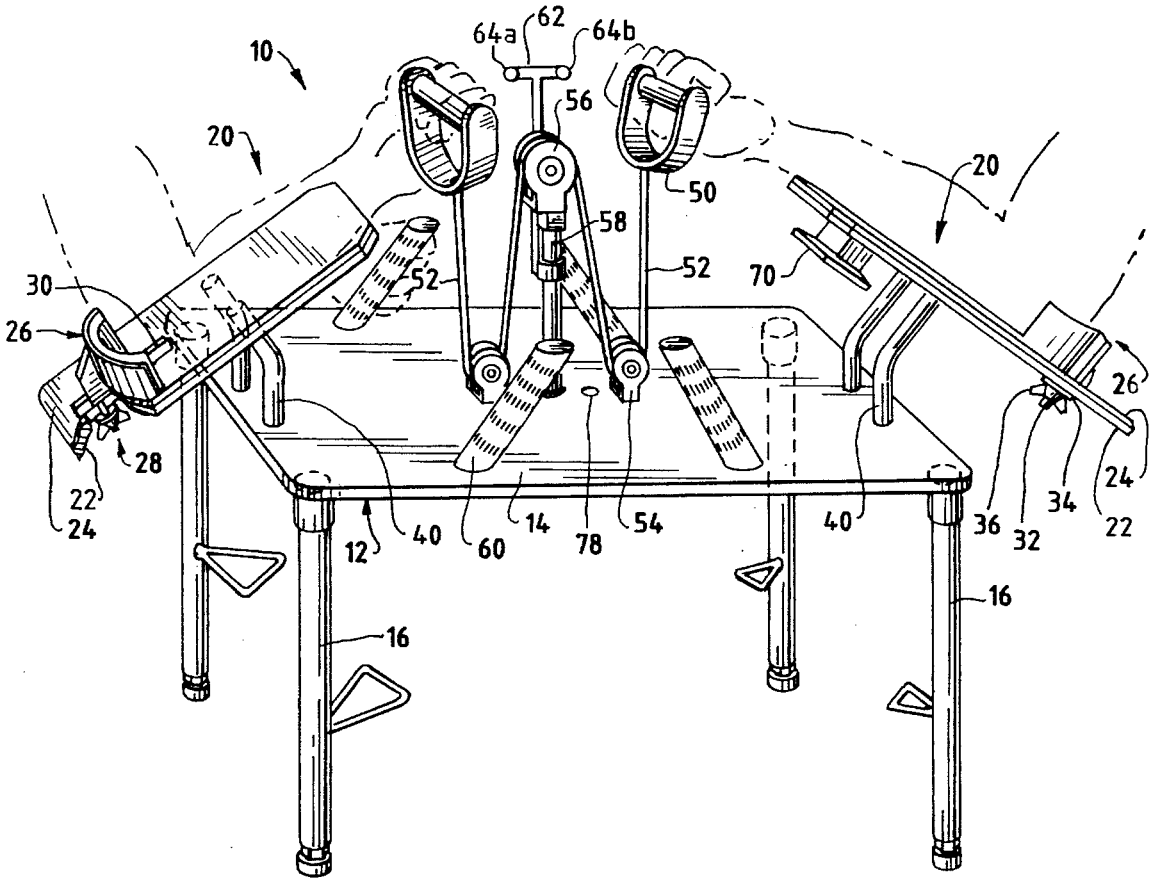
FIG. 1 is a perspective view of a preferred embodiment of a wrist wrestling and exercise apparatus in accordance with the invention shown in a wrist-wrestling configuration.

A preferred embodiment of a wrist wrestling and exercise apparatus 10 is illustrated in FIG. 1. Referring to FIG. 1, the apparatus 10 has a base in the form of a table 12, which is preferably composed of steel, having a flat support member 14 supported by four cylindrical legs 16.

A pair of forearm supports 20 are fixed to the top of the table 12. Each forearm support 20 is composed of a support member 22 in the form of a flat steel plate, a layer of padding 24 disposed on top of the steel plate 22, a curved elbow support 26, and an adjustment mechanism 28 for adjusting the position of the elbow support 26 with respect to the plate 22.

The adjustment mechanism 28 is composed of a slot 30 formed in each plate 22 (and padding 24), a screw 32 fixed to the bottom portion of the elbow support 26, a washer 34, and a wing nut 36 which is threadably attached to the screw 32. The position of the elbow support 26 may be adjusted along the length of the plate 22 by loosening the wing nut 36, moving the elbow support 26 within the slot 30 (the screw 32 passes through the slot 30) to the desired position, and tightening the wing nut 36 so that the elbow support 26 is fixed in that position.

Each plate 22 of each forearm support 20 is held by a pair of cylindrical steel rods 40 in a fixed position relative to the tabletop 14, each plate 22 being inclined at an angle of between about 10° and 70° with respect to a horizontal plane parallel to the tabletop 14.

Each forearm support 20 has a handle 50 associated with it, each handle 50 being adapted to be gripped by the hand of a person. The handles 50 are operatively interconnected via a steel cable 52 which is supported in a "W" configuration by a pair of lower pulleys 54 attached to the tabletop 14 and a central pulley 56 attached to the tabletop 14 via a cylindrical steel rod 58, so that the displacement of one handle 50 relative to its associated forearm support 20 causes displacement of the other handle 50 relative to its associated forearm support 20.

Four steel handgrips 60 are fixed to the tabletop 14 at an angle, and a T-shaped light pole 62 is fixed to the support rod 58. The light pole 62 supports a pair of light bulbs **64*a*, 64*b*, each of which may be activated by a respective position detector 66 which detects when the position of a person's wrist is bent beyond a predetermined angle relative to the forearm support 20**, as described below.

Figure 3:
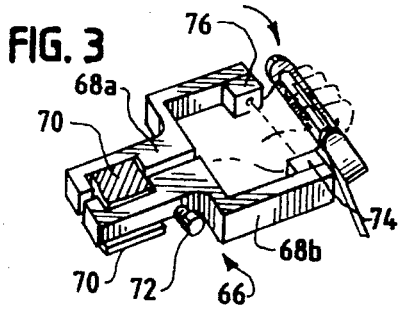
FIG. 3 is a perspective view of a detector for detecting the position of a hand with respect to the apparatus.

The structure of the position detectors 66 is illustrated in FIG. 3. Each detector 66 is composed of a pair of clamping members **68*a*, 68*b* which together form a C-shaped opening with a width that is sufficient to allow passage of a hand therethrough. The clamping members 68*a*, 68*b* are clamped to a steel post 70 fixed to the bottom surface of each forearm support 20 via a bolt 72. Each position detector 66 is provided with a conventional sensing mechanism, such as a laser sensor, composed of a transmitter 74 attached to the end of the clamping member 68*b* and a receiver 76 attached to the end of the clamping member 68*a***.

During operation, the transmitter 74 continuously transmits a laser beam to the receiver 76. If the receiver 76 detects any interruption of the laser beam from the transmitter 74, due to a hand blocking the path from the transmitter 74 to the receiver 76, the receiver 76 generates an interrupt signal which is transmitted to an electronic switch (not shown) that causes one of the lights **64*a*, 64*b* to go on. Referring to FIG. 1, if the position detector 66 associated with the right forearm support 20 is triggered by the downward movement of the hand supported by that support 20, the light 64*b* on the right-hand side of the apparatus 10** is illuminated to indicate the downward movement of the right person's hand.

When the apparatus is used for wrist wrestling, each of the two competitors adjusts the position of his elbow support 26 so that, when he places his forearm in his forearm support 20, the position of his wrist joint is slightly above, e.g. 1½ inches above, the upper end of the forearm support 20. Each competitor then grasps one of the handles 50 with the arm being supported by the forearm support 20, and may grasp one of the hand grips 60 with his free hand.

When both of the competitors' hands are in the same position relative to the upper end of each forearm support 20, the referee may signal the start of the contest, after which each competitor tries to bend his wrist upwards, forcing the other competitor's hand downwards, due to the interconnection of the handles 50 via the cable 52. The competitor who forces the other person's hand down sufficiently to trigger that person's position detector 66 is the winner of the contest.

Figure 2:
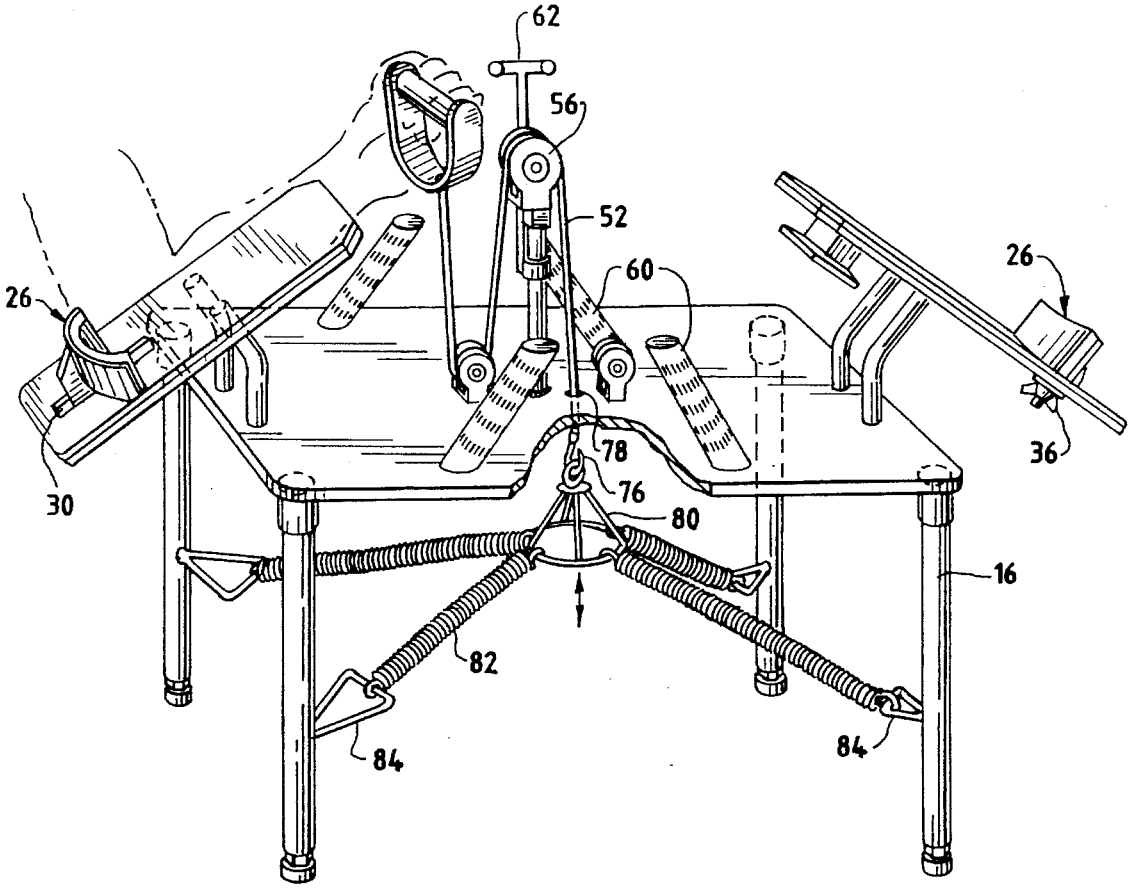
FIG. 2 is a perspective view of a preferred embodiment of the wrist wrestling and exercise apparatus of FIG. 1 shown in an exercise configuration.

The apparatus 10 may also be used by a single person in an exercise or therapeutic configuration. Referring to FIG. 2, when the apparatus 10 is used in this configuration, one of the handles 50 is detached from the cable 52 (one or both of the handles 50 are removably attached to the cable 52 by a pair of conventional hooks 76, one of which is shown in FIG. 2).

The free end of the cable 52 is then passed through a hole 78 in the tabletop 14 which lies directly below one side of the pulley 56 and is connected to a coupler 80 to which one end of each of four springs 82 are removably attached. The other ends of the springs 82 are removably attached to the four legs 16 of the table 12 via four steel triangles 84 welded to the legs 16 (the steel triangles 84 on the left-hand side of the apparatus 10 are larger than those on the right-hand side to accommodate for the fact that the hole 78 is not in the exact center of the tabletop 14).

When configured as shown in FIG. 2, the apparatus 10 can be used in an exercise or therapeutic mode in which a person repeatedly forces his hand upwards against the resistance provided by the springs 82 to strengthen his forearm muscles. A number of different sets of springs 82 could be provided with the apparatus 10 to give the user a range of resistance values to exercise with.

Figure 4:
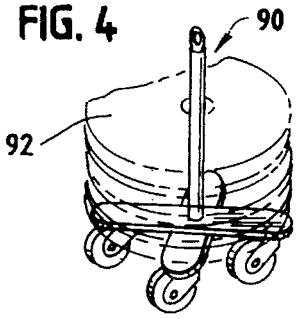
FIG. 4 is a perspective view of a support carriage for supporting a number of weights that may be attached to the apparatus when used in the exercise configuration.

Referring to FIG. 4, when the apparatus 10 is used in its exercise configuration, the spring coupler 80 and the springs 82 could be replaced by a rolling carrier 90 on which one or more weights 92 could be placed. The use of the carrier 90 allows a significantly greater resistance to be used since it may accommodate up to 300–400 pounds.

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A wrist wrestling apparatus, comprising:

a base;

a first forearm support disposed on said base, said first forearm support having a first support member adapted to support a forearm, a first elbow support coupled to said first support member, and means for adjusting the position of said first elbow support along said first support member, said first support member being inclined at an angle of between about 10° and about 70° with respect to a horizontal plane;

a second forearm support disposed on said base, said second forearm support having a second support member adapted to support a forearm, a second elbow support coupled to said second support member, and means for adjusting the position of said second elbow support along said second support member, said second support member being inclined at an angle of between about 10° and about 70° with respect to a horizontal plane;

a first handle associated with said first forearm support, said first handle being adapted to be gripped by a hand of a first person and being movable relative to said first forearm support;

a second handle associated with said second forearm support, said second handle being adapted to be gripped by a hand of a second person and being movable relative to said second forearm support;

means for operatively interconnecting said first and second handles so that displacement of said first handle relative to said first forearm support causes displacement of said second handle relative to said second forearm support;

a first detector associated with said first forearm support for detecting the position of the hand of the first person;

a second detector associated with said second forearm support for detecting the position of the hand of the second person;

a first visual indicator operatively coupled to said first detector for generating a visual signal indicating that the hand of the first person has reached a predetermined position; and a second visual indicator operatively coupled to said second detector for generating a visual signal indicating that the hand of the second person has reached a predetermined position.

2. An apparatus as defined in claim 1 wherein said means for interconnecting said first and second handles comprises a cable connected to said first and second handles and a plurality of pulleys for supporting said cable.

3. An apparatus as defined in claim 1 wherein each of said detectors comprises means for generating a horizontally disposed beam at a location below an upper edge of one of said forearm supports.

4. A wrist wrestling apparatus, comprising:

a base;

a first forearm support disposed on said base;

a second forearm support disposed on said base;

a first handle associated with said first forearm support, said first handle being adapted to be gripped by a hand of a first person and being movable relative to said first forearm support;

a second handle associated with said second forearm support, said second handle being adapted to be gripped by a hand of a second person and being movable relative to said second forearm support; and means for operatively interconnecting said first and second handles so that displacement of said first handle relative to said first forearm support causes displacement of said second handle relative to said second forearm support.

5. A wrist wrestling apparatus, comprising:

a base;

a first forearm support disposed on said base;

a second forearm support disposed on said base;

a first handle associated with said first forearm support, said first handle being adapted to be gripped by a hand of a first person and being movable relative to said first forearm support;

a second handle associated with said second forearm support, said second handle being adapted to be gripped by a hand of a second person and being movable relative to said second forearm support; and means for operatively interconnecting said first and second handles so that displacement of said first handle relative to said first forearm support causes displacement of said second handle relative to said second forearm support, wherein said first forearm support is inclined at an angle of between about 10° and about 70° with respect to a horizontal plane and wherein said second forearm support is inclined at an angle of between about 10° and about 70° with respect to a horizontal plane.

6. A wrist wrestling apparatus, comprising:

a base;

a first forearm support disposed on said base;

a second forearm support disposed on said base;

a first handle associated with said first forearm support, said first handle being adapted to be gripped by a hand of a first person and being movable relative to said first forearm support;

a second handle associated with said second forearm support, said second handle being adapted to be gripped by a hand of a second person and being movable relative to said second forearm support;

means for operatively interconnecting said first and second handles so that displacement of said first handle relative to said first forearm support causes displacement of said second handle relative to said second forearm support; and at least one hand grip disposed on said base, said hand grip being positioned on said base so that said hand grip can be held by one hand of a person while the other hand of the person is holding one of said handles while the forearm of the other hand of the person is supported by one of said forearm support members.

7. An apparatus as defined in claim 4 additionally comprising two pairs of hand grips disposed on said base.

8. An apparatus as defined in claim 4 wherein said means for interconnecting said first and second handles comprises a cable connected to said first and second handles and a plurality of pulleys for supporting said cable.

9. A wrist wrestling apparatus, comprising:

a base;

a first forearm support disposed on said base;

a second forearm support disposed on said base;

a first handle associated with said first forearm support, said first handle being adapted to be gripped by a hand of a first person and being movable relative to said first forearm support;

a second handle associated with said second forearm support, said second handle being adapted to be gripped by a hand of a second person and being movable relative to said second forearm support;

means for operatively interconnecting said first and second handles so that displacement of said first handle relative to said first forearm support causes displacement of said second handle relative to said second forearm support; and a first detector associated with said first forearm support for detecting the position of the hand of the first person and a second detector associated with said second forearm support for detecting the position of the hand of the second person.

10. An apparatus as defined in claim 9 additionally comprising:

a first visual indicator operatively coupled to said first detector for generating a visual signal indicating that the hand of the first person has reached a predetermined position; and a second visual indicator operatively coupled to said second detector for generating a visual signal indicating that the hand of the second person has reached a predetermined position.

11. An apparatus as defined in claim 10 wherein each of said first and second visual indicators comprises a light bulb.

12. An apparatus as defined in claim 9 wherein each of said detectors comprises means for generating a horizontally disposed beam at a location below an upper edge of one of said forearm supports.

13. A wrist wrestling apparatus, comprising:

a base;

a first forearm support disposed on said base;

a second forearm support disposed on said base;

a first handle associated with said first forearm support, said first handle being adapted to be gripped by a hand of a first person and being movable relative to said first forearm support;

a second handle associated with said second forearm support, said second handle being adapted to be gripped by a hand of a second person and being movable relative to said second forearm support; and means for operatively interconnecting said first and second handles so that displacement of said first handle relative to said first forearm support causes displacement of said second handle relative to said second forearm support, wherein each of said forearm supports comprises:

a support member adapted to support a forearm;

an elbow support coupled to said support member; and means for adjusting the position of said elbow support along said support member.

14. A wrist wrestling apparatus, comprising:

a base;

a first forearm support disposed on said base;

a second forearm support disposed on said base;

a first handle associated with said first forearm support, said first handle being adapted to be gripped by a hand of a first person and being movable relative to said first forearm support;

a second handle associated with said second forearm support, said second handle being adapted to be gripped by a hand of a second person and being movable relative to said second forearm support; and means for operatively interconnecting said first and second handles so that displacement of said first handle relative to said first forearm support causes displacement of said second handle relative to said second forearm support, wherein said base comprises a table.

* * * * *